US008333047B2

(12) United States Patent
Nieto et al.

(10) Patent No.: US 8,333,047 B2
(45) **Date of Patent: *Dec. 18, 2012**

(54) METHOD FOR STRENGTHENING A STRUCTURE AND ASSOCIATED ANCHORAGE UNIT

(75) Inventors: Jean-Francois Nieto, Maurepas (FR); Christian Tourneur, Le Mesnil Saint Denis (FR)

(73) Assignee: Freyssinet International (STUP), Velizy Cedex (FR)

( * ) Notice: Subject to any disclaimer, the term of this patent is extended or adjusted under 35 U.S.C. 154(b) by 0 days.

This patent is subject to a terminal disclaimer.

(21) Appl. No.: 13/243,625

(22) Filed: Sep. 23, 2011

(65) Prior Publication Data

US 2012/0011788 A1 Jan. 19, 2012

Related U.S. Application Data

(63) Continuation of application No. 10/901,321, filed on Jul. 28, 2004, now Pat. No. 8,104,246.

(30) Foreign Application Priority Data

Jul. 28, 2003 (FR) ..... 03 09225

(51) Int. Cl.
*E04B 1/00* (2006.01)
*E04G 21/00* (2006.01)
*E04G 23/00* (2006.01)

(52) U.S. Cl. ..... 52/745.21; 52/223.13

(58) Field of Classification Search ..... 52/223.1, 52/223.13, 223.14, 704, 223.6, 745.21; 24/69 WT, 24/71 CT, 122.3; 248/231.91; 254/29 A; 405/259.1, 286, 288, 302.1, 302.2
See application file for complete search history.

(56) References Cited

U.S. PATENT DOCUMENTS

| | | | |
|---|---|---|---|
| 742,332 | A | 10/1903 | Kunny et al. |
| 1,107,889 | A | 8/1914 | Burns |
| 1,686,424 | A | 10/1928 | Thomson et al. |
| 1,746,879 | A | 2/1930 | Varney |
| 1,909,332 | A | 5/1933 | Blackburn |
| 1,958,747 | A | 5/1934 | Fiege |
| 2,057,881 | A | 10/1936 | Creamer |

(Continued)

FOREIGN PATENT DOCUMENTS

| | | |
|---|---|---|
| GB | 846346 | 8/1960 |

(Continued)

OTHER PUBLICATIONS

Re. 27,954 entitled "Anchor for Post-Tensioning Prestressed Concrete" issued on Apr. 2, 1974.

(Continued)

*Primary Examiner* — Basil Katcheves
*Assistant Examiner* — Theodore Adamos
(74) *Attorney, Agent, or Firm* — Banner & Witcoff, Ltd.

(57) ABSTRACT

The invention therefore proposes an anchorage unit for anchoring at least one prestressing member, capable of being tensioned, onto a structural component to be strengthened or repaired by additional prestressing. The anchorage unit includes means of fixing onto the structural component and means of anchoring the prestressing member located adjacent to a first side of the anchorage unit oriented towards a regular section of the prestressing member. The fixing means are located adjacent to a second side, opposite the first side, of the anchorage unit, which is so provided that it may be put into traction when the prestressing member is tensioned.

16 Claims, 3 Drawing Sheets

U.S. PATENT DOCUMENTS

| | | | | | |
|---|---|---|---|---|---|
| 2,163,677 | A | | 6/1939 | Goeller | |
| 2,205,348 | A | | 6/1940 | Del Camp | |
| 2,270,240 | A | | 1/1942 | Freyssinet | |
| 2,294,398 | A | | 9/1942 | Ferguson | |
| 2,211,615 | A | | 8/1943 | Brickman et al. | |
| 2,328,033 | A | | 8/1943 | Schorer | |
| 2,371,882 | A | | 3/1945 | Freyssinet | |
| 2,449,276 | A | | 9/1948 | Chalos | |
| 2,533,064 | A | | 12/1950 | Streader | |
| 2,614,801 | A | | 10/1952 | Mazzei | |
| 2,668,280 | A | | 2/1954 | Dupre | |
| 3,205,300 | A | | 9/1965 | Becker | |
| 3,255,558 | A | | 6/1966 | Middendorf | |
| 3,293,811 | A | | 12/1966 | Rice | |
| 3,399,434 | A | | 9/1968 | Kelly | |
| 3,462,543 | A | | 8/1969 | Wahl et al. | |
| 3,524,228 | A | | 8/1970 | Kelly | |
| 3,551,959 | A | | 1/1971 | Mastalski | |
| 3,606,231 | A | | 9/1971 | Kilborn | |
| 3,685,934 | A | | 8/1972 | Huber et al. | |
| 3,703,748 | A | | 11/1972 | Kelly | |
| 3,705,376 | A | | 12/1972 | Kinkaid et al. | |
| 3,757,390 | A | | 9/1973 | Edwards | |
| 3,762,027 | A | | 10/1973 | Burtelson | |
| 3,795,949 | A | | 3/1974 | Shorter | |
| 3,801,067 | A | | 4/1974 | Shorter | |
| 3,877,113 | A | | 4/1975 | Reyes | |
| 3,895,879 | A | | 7/1975 | Burtelson | |
| 3,937,607 | A | | 2/1976 | Rodormer | |
| 3,973,297 | A | | 8/1976 | Bruinette | |
| 4,053,974 | A | | 10/1977 | Howlett et al. | |
| 4,203,267 | A | | 5/1980 | Langhorst | |
| 4,304,078 | A | | 12/1981 | Meriwether, Jr. | |
| 4,330,970 | A | | 5/1982 | Bonink | |
| 4,337,923 | A | | 7/1982 | Smith | |
| 4,349,300 | A | * | 9/1982 | Kelley | 405/288 |
| 4,363,462 | A | | 12/1982 | Wlodkowski et al. | |
| 4,395,161 | A | * | 7/1983 | Wilson et al. | 405/302.1 |
| 4,460,420 | A | | 7/1984 | Estrada | |
| 4,510,723 | A | | 4/1985 | Soum | |
| 4,616,458 | A | | 10/1986 | Davis et al. | |
| 4,630,974 | A | * | 12/1986 | Sherman | 405/288 |
| 4,678,360 | A | | 7/1987 | Miller | |
| 4,680,906 | A | | 7/1987 | Prevedini | |
| 4,700,828 | A | | 10/1987 | Lane, Jr. | |
| 4,724,639 | A | | 2/1988 | Moser | |
| 4,812,096 | A | | 3/1989 | Peterson | |
| 4,821,474 | A | | 4/1989 | Rodriguez | |
| 4,835,822 | A | | 6/1989 | Savall et al. | |
| 4,960,348 | A | * | 10/1990 | Seegmiller | 405/259.1 |
| 5,024,032 | A | | 6/1991 | Rodriguez | |
| 5,058,469 | A | | 10/1991 | Rodriguez | |
| 5,079,879 | A | | 1/1992 | Rodriguez | |
| 5,168,681 | A | * | 12/1992 | Ayrapetyan | 52/223.7 |
| 5,231,752 | A | | 8/1993 | Hereford | |
| 5,271,199 | A | * | 12/1993 | Northern | 52/223.13 |
| 5,342,568 | A | | 8/1994 | Yokota | |
| 5,440,842 | A | | 8/1995 | Sorkin | |
| 5,466,095 | A | * | 11/1995 | Scott | 405/302.2 |
| 5,535,561 | A | | 7/1996 | Schuyler | |
| 5,544,982 | A | * | 8/1996 | Seegmiller | 405/288 |
| 5,594,977 | A | | 1/1997 | McCallion | |
| 5,671,572 | A | | 9/1997 | Siller-Franco | |
| 5,718,090 | A | | 2/1998 | Wei-Hwang | |
| 5,755,535 | A | * | 5/1998 | Fox | 405/288 |
| 5,802,788 | A | | 9/1998 | Ozawa et al. | |
| 5,839,235 | A | | 11/1998 | Sorkin | |
| 5,897,102 | A | | 4/1999 | Sorkin | |
| 5,939,003 | A | | 8/1999 | Crigler et al. | |
| 6,145,268 | A | | 11/2000 | Korzen | |
| 6,195,949 | B1 | | 3/2001 | Schuyler | |
| 6,230,448 | B1 | | 5/2001 | Oliver et al. | |
| 6,234,709 | B1 | | 5/2001 | Sorkin | |
| 6,318,038 | B1 | | 11/2001 | Park | |
| 6,354,596 | B1 | | 3/2002 | Rodriguez | |
| 6,393,781 | B1 | | 5/2002 | Sorkin | |
| 6,625,945 | B2 | * | 9/2003 | Commins | 52/293.3 |
| 6,748,708 | B1 | | 6/2004 | Fuzier et al. | |
| 6,817,148 | B1 | | 11/2004 | Sorkin | |
| 7,174,685 | B2 | | 2/2007 | Hayes | |
| 7,261,494 | B2 | * | 8/2007 | Stankus et al. | 405/288 |
| 7,717,650 | B2 | * | 5/2010 | Reschke et al. | 405/302.1 |
| 2001/0002529 | A1 | * | 6/2001 | Commins et al. | 52/481.1 |
| 2003/0009962 | A1 | * | 1/2003 | Hughes | 52/223.6 |
| 2005/0115188 | A1 | * | 6/2005 | Wallstein et al. | 52/698 |
| 2007/0264090 | A1 | * | 11/2007 | Reschke et al. | 405/288 |

FOREIGN PATENT DOCUMENTS

| | | |
|---|---|---|
| WO | 9957390 | 11/1999 |

OTHER PUBLICATIONS

NF P 95-104, "Repair and Strengthening of Concrete and Masonry Structures" published Dec. 1992 by the French standards association (AFNOR).

* cited by examiner

METHOD FOR STRENGTHENING A STRUCTURE AND ASSOCIATED ANCHORAGE UNIT

CROSS REFERENCE TO RELATED APPLICATIONS

This is a continuation application of Ser. No. 10/901,321 filed Jul. 28, 2004 entitled "Method for Strengthening a Structure and Associated Anchorage Unit" which claims benefit to application No. FR 03 09225 filed Jul. 28, 2003 for which priority is claimed and which applications are incorporated herein by reference.

BACKGROUND OF THE INVENTION

The present invention concerns strengthening of structures and more specifically strengthening of structures according, to the additional prestressing method.

Additional prestressing is a known method for strengthening or repairing concrete or masonry structures and has formed the subject of standard NF P95-104 ("Repair and strengthening of concrete and masonry structures", published in December 1992 by the French standards association (AFNOR)).

It involves generating prestressing forces by putting reinforcing members into tension, for example prestressing cables, external to the structure to be strengthened. The reinforcing members transmit forces to the structure through anchorages bearing on spirally reinforced concrete or metal parts, called bosses, offset from structural components such as existing bracings, beams or walls.

As specified in section 5.2 of standard NF P 95-104, these anchorages are generally fixed by pinning using prestressing bars.

Concrete bosses are voluminous units, which can either be cast in place or precast. However, boss installation proves delicate in either case, especially because of the difficulty in accessing structural components on which bosses must bear. Openings or windows must sometimes be created in the structure to allow bosses to be installed.

Metal bosses are shop-fabricated for adaptation to each structure, which ensures their superior fabrication quality compared with concrete bosses. To allow such bosses to have a surface with a sufficiently high friction coefficient bearing on a concrete structural component, this bearing surface must be serrated by machining it or by welding steel wires to it, leading to high construction cost.

According to the method recommended by standard NF P 95-104, reinforcing members pass through the bosses in which they are anchored. Such an anchorage is always made inside the boss on the side opposite to the reinforcing member regular section. It thereby compresses the boss when the reinforcing members are tensioned.

FIG. 1 shows an example of such an anchorage. In the embodiment illustrated in this figure, a boss 1 bears on a bracing 3 of the structure to be strengthened. A prestressing member 2 passes through boss 1 for anchorage therein, at the end opposite the regular section of the prestressing member 2.

Moreover, bosses foreseen by the standard are positioned at the ends of the structure to be strengthened, such that the additional prestress is applied over the longest possible distance. They are therefore often placed near to obstructions, such as structural walls, columns or bracings. This arrangement makes it difficult to place the reinforcing-member tensioning jack.

For this reason, it is generally necessary to displace the boss away from the obstruction to ensure enough clearance to position the jack, which effectively limits prestressing to only a subsidiary part of the structure. Alternatively, the boss may be placed near the obstruction on condition, however, that an opening is made in this obstruction to allow the jack to be positioned. Applying the resulting prestress is better than in the former case, but this solution requires concrete break-out or drilling work to be performed.

One object of the present invention is to overcome the drawbacks of the current methods recalled above by allowing prestress to be applied to a major section of the structural component to be strengthened, whilst avoiding implementation of work involving breaking out part of the structure for strengthening purposes.

Another object of the invention is to have an anchorage well suited to the structure to be strengthened, without requiring additional adaptation operations such as machining of an anchorage block surface bearing on a member of the structure to be strengthened.

SUMMARY OF THE INVENTION

The invention therefore proposes an anchorage unit for anchoring at least one prestressing member, capable of being tensioned, onto a structural component to be strengthened or repaired by additional prestressing, including means of fixing onto the said structural component and means of anchoring the prestressing member located adjacent to a first side of the anchorage unit oriented towards a regular section of the prestressing member. According to the invention, the fixing means are located adjacent to a second side, opposite the first side, of the anchorage unit, which is so provided that it may be put into traction when the prestressing member is tensioned.

When part of the structure, whose ends are not easily accessible, must be strengthened by additional prestressing, this anchorage unit enables the required compressive stress to be applied to the whole of the considered area. Because the anchorage unit works essentially in tension between the anchoring means adjacent to the first side and the fixing means adjacent to the opposing, second side, compressive stress is applied to the structure right up to the fixing means, in other words almost as far as the second side of the anchorage unit. This second side may be located near to an obstruction that would hamper implementation of conventional anchorages.

Moreover, the invention proposes a method for strengthening or repairing a structure by additional prestressing comprising implementation of such an anchorage unit. This method includes the following steps:

- fixing onto a structural component of the structure at least one anchorage unit comprising a section capable of anchoring at least one end of a prestressing member fixed at its other end to the structure, the said part of the anchorage unit being adjacent to a first side, oriented towards the regular section of the prestressing member, the structural component fixing being adjacent to a second side, opposite the first side, of the anchorage unit;
- tensioning the prestressing member, and
- anchoring the prestressing member inside the said section of the anchorage unit, such that the anchorage unit is put into traction.

DESCRIPTION OF PREFERRED EMBODIMENTS

Figures 2, 3:
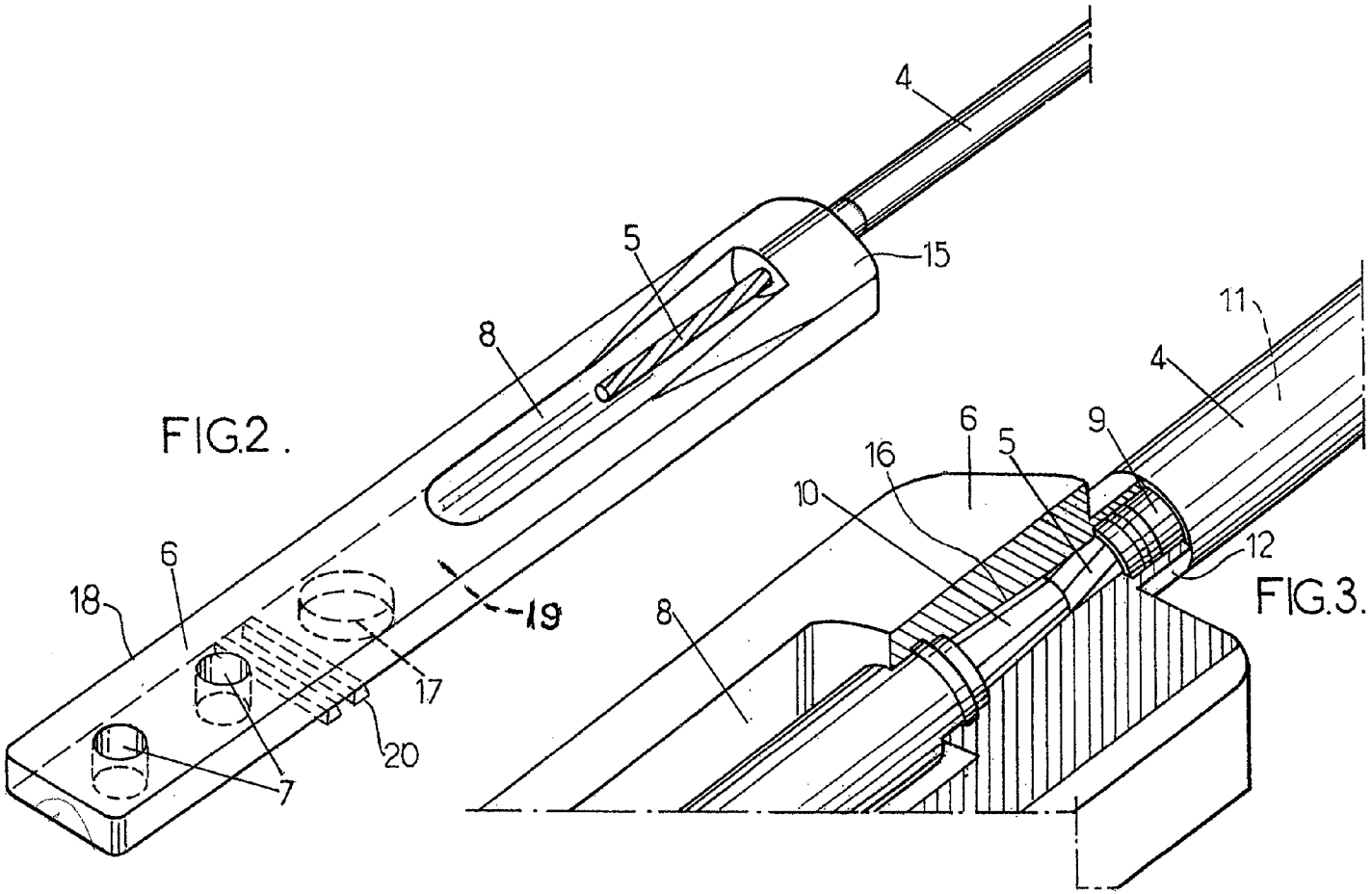
FIG. 2 is a simplified diagram of an anchorage unit according to the invention.
FIG. 3 is a sectional view of a portion of the anchorage unit shown in FIG. 2 and of the anchorage formed in this portion.

FIG. 2 represents an anchorage unit 6 according to the invention. This unit is capable of anchoring a reinforcing member also designated by prestressing member or a set of reinforcing members to strengthen a structural component by additional prestressing.

Reinforcing members used for prestressing are conventionally metallic. In particular, they may feature strands 5 capable of being tensioned and forming a cable in their regular section, in other words between anchorage zones. Strands are generally protected from corrosion in their regular section, for example by a high-density polyethylene (HDPE) sheath 4 enclosing the strands and injected with cement grout or a non-adhesive soft material such as grease or wax.

The anchorage unit 6 is integral and compact. It is favourably made of cast iron. At one of its ends (on the right in FIG. 2), it features an orifice allowing reception of at least one strand 5 of the cable, whose sheath terminates at the anchorage unit input. A housing 8 is provided in the anchorage unit 6 to receive the end of the strand 5. It is open on one face of the anchorage unit 6, such that the anchored end of the strand 5 is accessible from outside the anchorage unit 6.

FIG. 3 shows more specifically an example of an anchorage formed within anchorage unit 6. The strand 5 penetrates into the anchorage unit 6. The end of the anchorage unit receiving the strand has an orifice capable of accommodating an anchoring jaw. The orifice may, for example, be frustoconical, in which case the jaw 10 wedges itself in the orifice by conical wedging. Once the strand 5 is tensioned to generate prestress, it will then be firmly clamped by the jaw 10.

Furthermore, in an advantageous embodiment, the cast iron anchorage unit 6 may be cast to feature orifices that permit sealing of prestressing cable sheath 4 connections with the anchorage unit 6. A connection collar 9 and seals may then be inserted into these anchorage unit 6 entry orifices to ensure such a seal.

Figure 4:
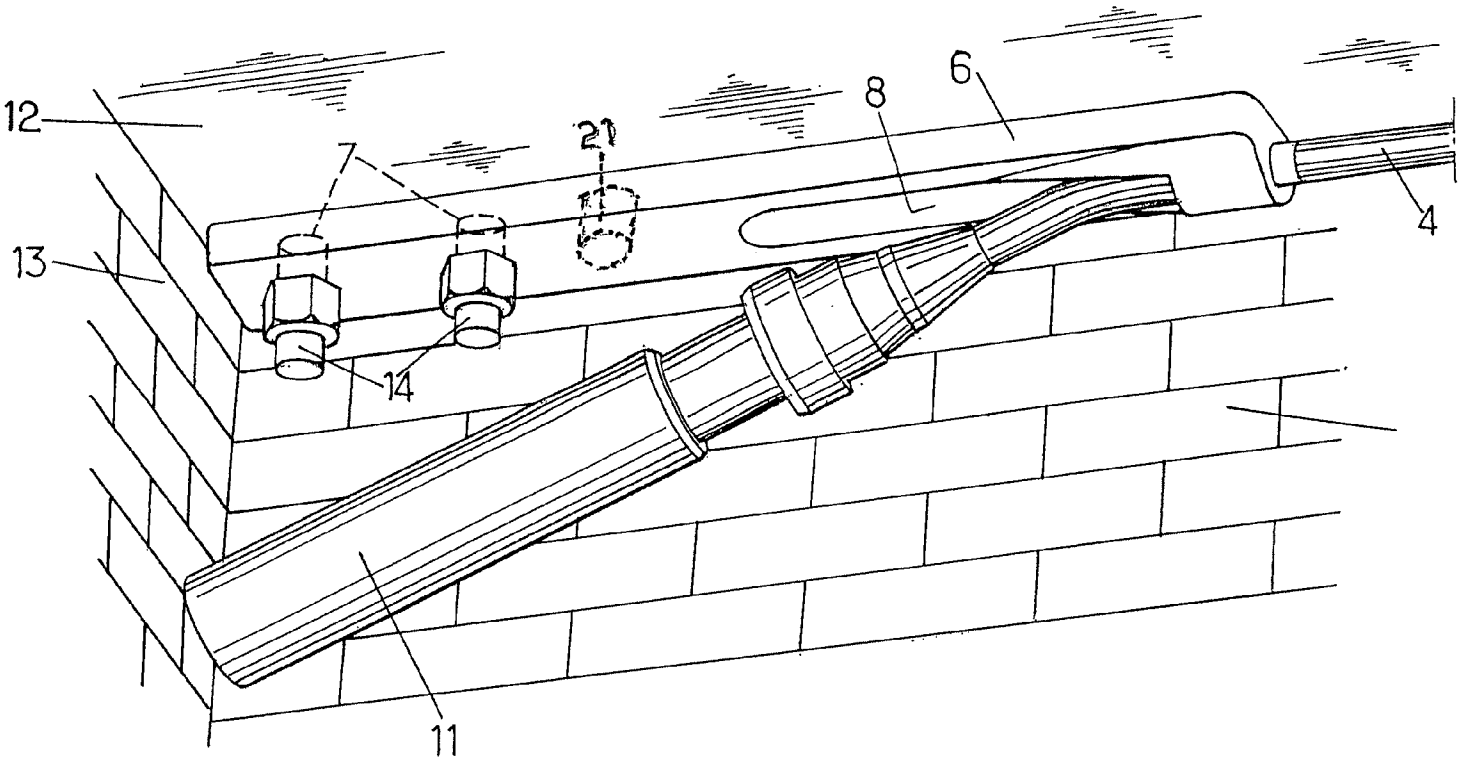
FIG. 4 represents a method of strengthening a structural component according to the invention.

Moreover, the anchorage unit 6 has means of fixing onto the structural component to be strengthened or repaired, which may be an industrial building floor, for example. FIG. 4 shows an example of fixing the anchorage unit 6 onto a floor slab 12. The anchorage unit 6 may be fixed, for example, by pinning one or more prestressing bars 14 into the floor slab 12. In this case, orifices 7 may be provided in the anchorage unit 6 to allow prestressing bars to be introduced.

According to the invention, the anchorage unit 6 section opposite the strand 5 anchorage, in other words the anchorage unit 6 section furthest away from the prestressing cable regular section, is fabricated such that it may be fixed onto the structural component to be strengthened. In FIGS. 2 and 4, therefore, the orifices 7 capable of receiving the prestressing bars are located in the left-hand section of the anchorage unit 6.

Figure 1:
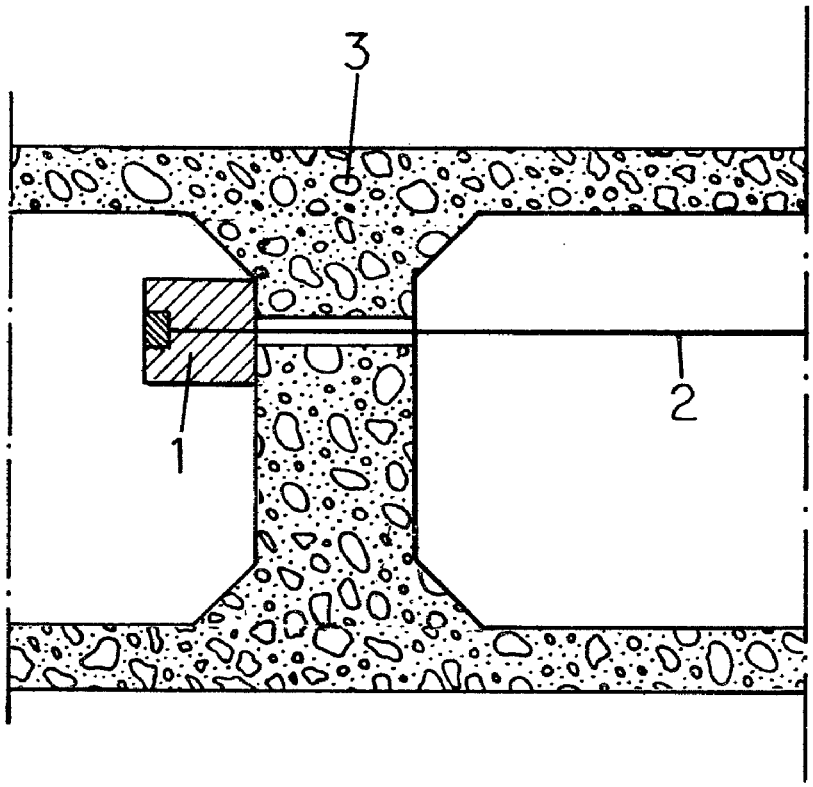
FIG.1. ( PRIOR ART )
FIG. 1, already commented upon, is a diagrammatic sectional view of a device for strengthening a structure by additional prestressing, as specified in AFNOR standard NF P 95-104.

As represented in FIG. 4, the anchorage unit 6 is therefore understood to be put into traction when the strand 5 is tensioned. The strand 5 exerts effectively a tensile force on the right-hand section of the anchorage unit 6 in the direction of the cable regular section, whilst anchorage unit 6 is fixed to floor slab 12 by pinning performed through its left-hand section. This type of anchorage therefore differs from conventional bosses 1, such as those shown in FIG. 1, which are compressed against a structural component as a result of the force exerted by the tensioned prestressing cable 2.

The combination so formed therefore allows the resultant of the pinning and tensioning forces to be transmitted to the structure to be strengthened.

In an advantageous embodiment, the anchorage unit fixed to the concrete floor slab 12 has a bearing surface featuring cast serrations in contact with the structural component. Such casting of the iron enables effective bonding of the anchorage unit 6 with the concrete to be obtained without having to perform expensive additional operations, for example machining of the anchorage unit 6.

The arrangement foreseen by the invention is particularly advantageous because it allows the strand to be tensioned without having to displace the anchorage away from the wall or obstruction 13, which backs onto the anchorage unit 6. The end of the strand is effectively accessible at the housing 8 of the anchorage unit 6. The housing 8 is located at the distance from the anchorage unit fixing zone (illustrated by the orifices 7). A tensioning jack fitted with a curved tip can easily be installed in the available space beneath the anchorage unit 6. Resorting to breaking out or drilling the wall 13 to tension the strand 5 may therefore be avoided, unlike the common practice with conventional bosses.

Moreover, such an arrangement permits sufficient excess length of cable for retensioning or, on the contrary, relaxing the strand 5 after initial tensioning and trimming of the strand 5.

A protective cap or sleeve 11 can be advantageously installed to protect the end of the strand 5 after it leaves the housing 8, as illustrated in FIG. 4.

When prestressing forces to be applied are very high, the prestressing bars "pinning" the anchorage units onto the structure may not be enough to anchor all the cable force exerted on the structure by friction because the friction coefficient of serrated cast iron on concrete (of the order of 0.6) requires a very high pinning force. In this case, it may be advantageous to transfer all forces between the anchorage unit and the structure by combining friction and direct bearing. Direct bearing is obtained, for example, by means of a recess 17 provided in the form of a blind hole in the anchorage unit face intended to be applied against the structure (FIG. 2). During construction, a bearing stud 21 of complementary shape to that of the recess 17 is fixed to the structure. To ensure a satisfactory distribution of forces between friction and direct bearing, there should be no play at this stud 21. This is ensured by injecting a sealant into the recess 17 when the anchorage unit 6 is installed. This sealant is a resin paste or a grout, for example.

The invention claimed is:

1. A method for strengthening or repairing a concrete or masonry structure by additional prestressing using a prestressing cable having at least one strand, including the following steps:

fixing onto a structural component of the structure at least one unitary anchorage unit comprising a prestressing cable anchorage end, an anchorage unit section opposite the prestressing cable anchorage end, and a bearing surface extending longitudinally between the prestressing cable anchorage end and the anchorage unit section, said prestressing cable anchorage end including means for anchoring at least one end of the prestressing cable capable of being tensioned along a substantial part of the structural component to be strengthened or repaired by additional prestressing wherein said anchorage unit section is fixed to a surface of said structural component, said bearing surface of the anchorage unit extending longitudinally substantially in the same direction as the prestressing cable, wherein said anchorage unit is so oriented and provided that it is put mainly into longitudinal traction when the prestressing cable is tensioned along said substantial part of the structural component and maintains said bearing surface on the structural component surface, whereby the anchorage unit does not pass through the structural component, said anchorage unit further comprising a side spaced from and opposite the bearing surface, said side including a generally longitudinal recess with an orifice and a generally longitudinal passage for substantially totally surrounding the prestressing cable extending generally longitudinally from the recess through the orifice, performing additional prestressing of said substantial part of the structural component by tensioning the prestressing cable along said substantial part of the structural component by tensioning means external to the anchorage unit, the prestressing cable being external to the structural component, and anchoring the prestressing cable at the prestressing cable anchorage end of said anchorage unit such that the anchorage unit is put into longitudinal traction.

2. The method according to claim 1, in which the anchorage unit is made of cast iron.

3. The method according to claim 1, in which fixing of the anchorage unit onto the structural component includes pinning using at least one prestressing bar.

4. The method according to claim 1, in which fixing of the anchorage unit onto the structural component includes introducing fixing means in at least one orifice of the anchorage unit.

5. The method according to claim 1, in which fixing of the anchorage unit onto the structural component includes applying the anchorage unit bearing face featuring cast serrations against the structural component.

6. The method according to claim 1, in which the structural component includes an obstruction, located opposite the prestressing cable, and in which fixing of the anchorage unit onto the structural component is performed such that the anchorage unit is positioned substantially near the obstruction.

7. The method according to claim 1, in which the prestressing cable comprises a prestressing cable enclosed by a sheath and in which said prestressing cable anchorage includes introducing the at least one end of the prestressing cable into at least one orifice in said anchorage unit, capable of ensuring anchorage, in such a way as to allow a sealed connection between the anchorage unit and the cable sheath.

8. The method according to claim 1, in which a bearing stud is moreover fixed to the structural component to operate in combination with a recess provided on the anchorage unit, and in which a sealant is injected into the recess when the anchorage unit must be placed on the structural component.

9. The method according to claim 1 wherein said tensioning means comprises a jack device.

10. The method of claim 1 wherein said prestressing cable is tensioned along said substantial part of the structural component without passing through said structural component.

11. The method of claim 1 further including positioning a fixing means in the passage to retain the prestressing cable.

12. The method of claim 1 including providing said passage with a frustoconical section located at the orifice for receipt of a wedge device.

13. The method of claim 1 wherein anchoring the prestressing cable comprises clamping said prestressing cable with a jaw device.

14. The method of claim 1 wherein the thickness of the anchorage unit between the bearing surface and opposite side is greater at the prestressing cable anchorage end.

15. A method for strengthening or repairing a concrete or masonry structure by additional prestressing using a prestressing cable having at least one strand, including the following steps:

fixing onto a structural component of the structure at least one unitary anchorage unit comprising a prestressing cable anchorage end, an anchorage unit section opposite the prestressing cable anchorage end, and a bearing surface extending longitudinally between the prestressing cable anchorage end and the anchorage unit section, said prestressing cable anchorage end including means for anchoring at least one end of the prestressing cable capable of being tensioned along a substantial part of the structural component to be strengthened or repaired by additional prestressing of the structural component without passing through said structural component wherein said anchorage unit section is fixed to a surface of said structural component, said bearing surface of the anchorage unit extending longitudinally substantially in the same direction as the prestressing cable, wherein said anchorage unit is so oriented and provided that it is put mainly into longitudinal traction when the prestressing cable is tensioned along said substantial part of the structural component and maintains said bearing surface on the structural component surface, whereby the anchorage unit does not pass through the structural component, said anchorage unit further comprising a side spaced from and opposite the bearing surface, said side including a generally longitudinal recess with an orifice and a generally longitudinal passage for substantially totally surrounding the prestressing cable extending generally longitudinally from the recess through the orifice, performing additional prestressing of said substantial part of the structural component by tensioning the prestressing cable along said substantial part of the structural component by tensioning means external to the anchorage unit, the prestressing cable being external to the structural component, and anchoring the prestressing member at the prestressing cable anchorage end of said anchorage unit such that the anchorage unit is put into longitudinal traction.

16. A method for strengthening or repairing a concrete or masonry structure by additional prestressing using a prestressing cable having at least one strand, including the following steps:

fixing onto a structural component of the structure at least one unitary anchorage unit comprising a prestressing cable anchorage end, an anchorage unit section opposite the prestressing cable anchorage end, and a bearing surface extending longitudinally between the prestressing cable anchorage end and the anchorage unit section, said prestressing cable anchorage end including means for anchoring one end of said prestressing cable capable of being tensioned along a substantial part of the structural component to be strengthened or repaired by additional prestressing without breaking out part of the structural component wherein said anchorage unit section is fixed to a surface of said structural component, said bearing surface of the anchorage unit extending longitudinally substantially in the same direction as the prestressing cable, wherein said anchorage unit is so oriented and provided that it is put mainly into longitudinal traction when the prestressing cable is tensioned along said substantial part of the structural component and maintains said bearing surface on the structural component surface, whereby the anchorage unit does not pass through the structural component, said anchorage unit further comprising a side spaced from and opposite the bearing surface, said side including a generally longitudinal recess with an orifice and a generally longitudinal passage for substantially totally surrounding the prestressing cable extending generally longitudinally from the recess through the orifice, performing additional prestressing of said substantial part of the structural component by tensioning the prestressing cable along said substantial part of the structural component by means of tensioning means external to the anchorage unit, the prestressing cable being external to the structural component, and anchoring the prestressing cable at the prestressing cable anchorage end of said anchorage unit such that the anchorage unit is put into longitudinal traction.

* * * * *